US005100289A

United States Patent [19]

Caoduro

[11] Patent Number: 5,100,289

[45] Date of Patent: Mar. 31, 1992

[54] SELF-PRIMING CENTRIFUGAL PUMP

[75] Inventor: Bruno Caoduro, Montecchio Magg, Italy

[73] Assignee: Ebara Corporation, Tokyo, Japan

[21] Appl. No.: 727,393

[22] Filed: Jul. 5, 1991

Related U.S. Application Data

[63] Continuation of Ser. No. 534,274, Jun. 7, 1990, abandoned.

[30] Foreign Application Priority Data

Jun. 7, 1989 [IT] Italy ..... 85605 A/89

[51] Int. Cl.[5] ..... F03B 11/00

[52] U.S. Cl. ..... 415/56.5; 415/206; 415/224.5; 417/423.5; 417/83

[58] Field of Search ..... 415/56.1, 56.2, 56.3, 415/56.4, 56.5, 56.6, 206, 203, 224.5, 199.5; 417/423.1, 423.14, 423.5, 423.8, 80, 81, 82, 83

[56] References Cited

U.S. PATENT DOCUMENTS

| | | | |
|---|---|---|---|
| 2,424,285 | 7/1947 | Piccardo et al. | 417/81 |
| 2,444,100 | 6/1948 | Hill | 417/83 |
| 2,524,269 | 10/1950 | Patterson | 417/82 |
| 2,631,539 | 3/1953 | Wolfe et al. | 415/199.1 |
| 2,853,014 | 9/1958 | Carpenter | 417/83 |
| 2,855,143 | 10/1958 | Schaer | 415/199.1 |
| 2,934,021 | 4/1960 | Conery et al. | 415/56.1 |
| 2,941,474 | 6/1960 | Hall | 417/83 |
| 2,945,448 | 7/1960 | Frederick | 415/56.3 |

FOREIGN PATENT DOCUMENTS

| | | | |
|---|---|---|---|
| 536144 | 1/1957 | Canada | 417/81 |
| 0361328 | 4/1990 | European Pat. Off. . | |
| 3718273 | 3/1988 | Fed. Rep. of Germany . | |
| 0323384 | 7/1989 | France . | |

*Primary Examiner*—Edward K. Look
*Assistant Examiner*—Hoang Nguyen
*Attorney, Agent, or Firm*—Wenderoth, Lind & Ponack

[57] ABSTRACT

The present invention relates to a self-priming centrifugal pump which includes a stator case with a delivery port and an outflow port and a radial-centrifugal bladed impeller. An ejector is provided inside the case and has an induction chamber which is connected to the intake port, an entrainment nozzle connected to the internal chamber of the stator case and a diffusion duct which is coaxial to the impeller and is connected to its inflow section. A conveyor is provided after the impeller and includes at least one radial-centripetal conveyance channel and an annular outflow section which extends peripherally to the diffusion duct of the ejector. The conveyor has a configuration which is suitable for directing the flow which leaves the impeller toward a central portion of the case which is adjacent to the outer portion of the diffusion duct and is distant from the delivery port, and for making the flow laminar so as to facilitate the separation of air and its migration toward the delivery port.

11 Claims, 2 Drawing Sheets

SELF-PRIMING CENTRIFUGAL PUMP

This application is a continuation of now abandoned application, Ser. No. 07/534,274 filed on June 7, 1990.

BACKGROUND OF THE INVENTION

1. Field of the Invention

The present invention relates to a self-priming centrifugal pump particularly of the kind having built-in ejector.

Self-priming pumps of this type, generally termed "jet pumps", comprise, inside the pump casing, an ejector which is connected to the intake port on one side and to the inlet of the impeller on the other.

2. Description of the Related Art

As is known, the impeller of said pumps must generate a total flow Q which is expressed by the formula:

$$Q=Q_1+Q_2$$

where $Q_1$ indicates the useful flow delivered by the pump and $Q_2$ indicates the partial flow which flows through the ejection nozzle. The flow $Q_2$, on the basis of the known operating principles of ejectors, draws into to the ejector's negative-pressure chamber a flow $Q_1$ which arrives from the intake port. Said flow $Q_1$ mixes in the diffusion duct of the ejector with the flow $Q_2$ and is then conveyed toward the inlet of the impeller to be subsequently recirculated within the case.

The method of operation of said self-priming pumps is as follows. Initially, the case of the pump must be entirely filled with liquid up to the intake port which is located above the longitudinal axis of the impeller. In this manner the ejector is also completely filled with liquid to be pumped.

When the pump is started, the impeller imparts a vorticose motion to the liquid, forming a mixture of air and liquid which is discharged into the upper portion of the case, where the separation of the air can occur at low speeds. The separated air partially flows to the delivery port and is partly entrained within the liquid flowing toward the ejection nozzle, where it gradually draws more liquid toward the inlet of the impeller. The recirculation of the air/liquid mixture continues until all the air is eliminated, after which the normal operation of the pump can begin.

By means of such a pump-ejector combination it is possible to automatically prime the system, lifting fluids even from considerable depths, up to approximately 9 meters and above. Said devices, however, are not free from disadvantages, including most of all long priming times and low efficiency during normal running conditions.

It has been experimentally demonstrated that the longer priming times correspond to conditions of greater turbulence of the air/liquid mixture which leaves the impeller. Said priming times are also further increased if the flow of the air/liquid mixture is proximate to the delivery port, so as to prevent the separation of air from the mixture and reduce the efficiency of the ejector. Therefore, in order to reduce priming times and increase the overall efficiency of the pump, it is necessary to carefully study the conditions of outflow at the outlet of the impeller and its re-conveyance toward the ejector.

In order to obviate this disadvantage, a self-priming ejector pump has been provided in which the flow leaving the impeller, initially guided by an annular diffuser, is subsequently conveyed toward an essentially frustum-shaped interspace and finally discharged through an arcuate slot which faces the intake port of the pump. Inside said frustum-shaped interspace there is a deflector blade which is connected to one of the front chambers of the annular diffuser. The priming times of said pump are considerably reduced down to 5–6 minutes; however, the efficiency of the pump-ejector assembly during normal running conditions is still not adequate. This is due to the fact that the outflow of the mixture through the arcuate slot is still predominantly turbulent and does not ensure a uniform feeding of the ejection nozzle.

SUMMARY OF THE INVENTION

The aim of the present invention is indeed to eliminate, or at least reduce, the disadvantages described above, by providing a self-priming centrifugal pump having a built-in ejector which allows to drastically reduce priming times by means of a simple and economical solution.

Within the scope of the above described aim, a particular object of the present invention is to provide a conveyance of the fluid in which the fluid leaves the impeller under substantially laminar conditions, so as to allow an effective separation of the air mixed with the liquid during priming and facilitate its migration toward the delivery port.

A further object of the present invention is to provide a conveyance device which reduces fluid dynamic losses during the priming period and during normal running conditions.

Another, but not least, object of the invention is to provide a centrifugal pump which is highly reliable and has reduced maintenance costs, in order to make the assembly rational and advantageous from a merely economical point of view.

BRIEF DESCRIPTION OF THE DRAWINGS

Further characteristics and advantages of the invention will become apparent from the description of two preferred but not exclusive embodiments of the self-priming centrifugal pump according to the invention, illustrated only by way of non-limitative example in the accompanying drawings, wherein.

DETAILED DESCRIPTION OF THE PREFERRED EMBODIMENT

Figure 1:
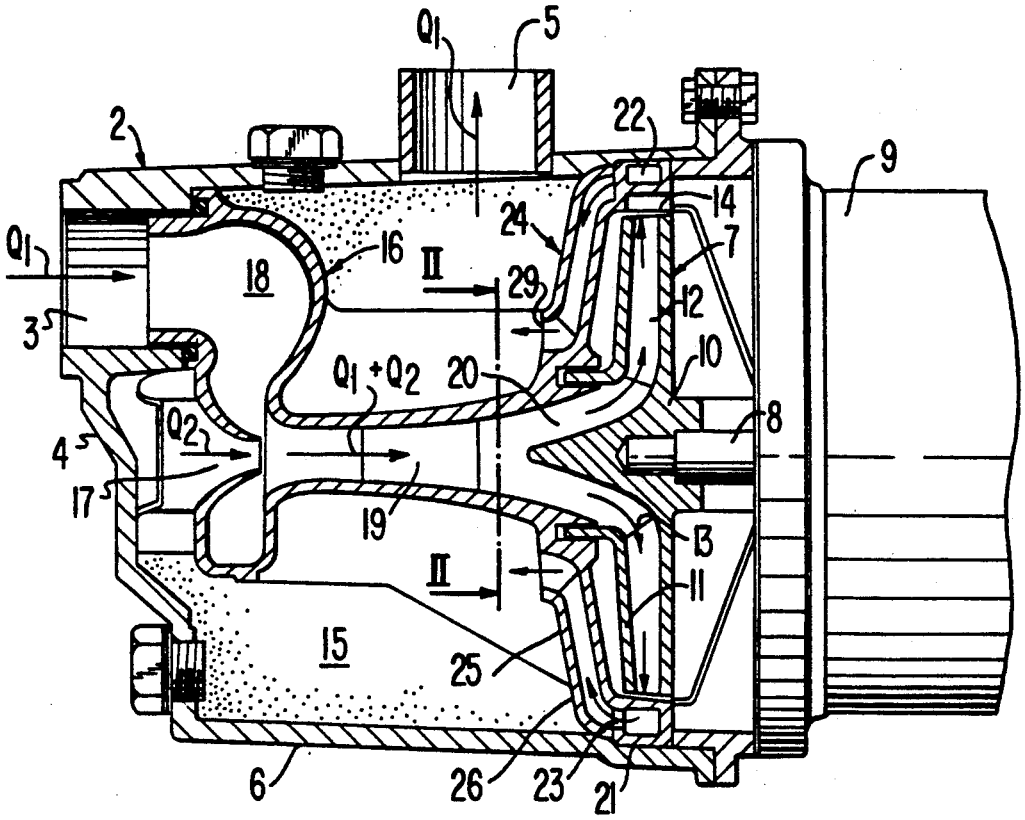
FIG. 1 is a partial sectional side view of a first embodiment of a pump according to the invention.
Figure 2:
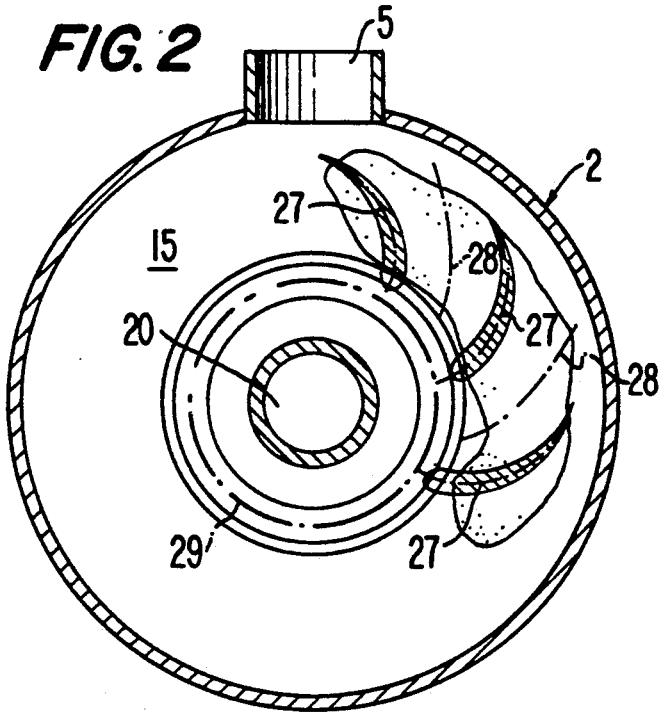
FIG. 2 is a sectional and partially exploded front view of the pump of FIG. 1, taken along the line II—II.

With reference to FIGS. 1 and 2, the pump according to the invention, generally indicated by reference numeral 1, comprises a casing or stator case 2 which has an essentially cylindrical shape and is provided with an intake port 3 defined on the front wall 4 and with a delivery port 5 arranged on the cylindrical side wall 6 in an upward position. Both ports 3 and 5 have couplings for connection to external channels, not illustrated, and are arranged above the longitudinal axis of the case. Plugs for filling and draining liquid are furthermore provided and are engaged in appropriate threaded cavities of the case.

The case 2 internally supports an impeller 7 which is keyed on a shaft 8 which is driven by the electric motor 9. The impeller 7, which has a per se known shape, has a hub 10, a crown 11 and a plurality of radial-centrifugal blades 12 with an appropriate profile. An inlet section 13 and an outlet section 14 are defined at the ends of the set of blades of the impeller 7 and determine the direction of flow during the rotation of the impeller.

An ejector, generally indicated by the reference numeral 16, is arranged in the internal chamber 15 of the stator case 2 and comprises an entrainment nozzle 17 which is traversed by the recirculation flow $Q_2$, a chamber 18 connected to the intake port 3 for drawing the useful flow $Q_1$, and a diffusion duct 19 in which the flows $Q_1$ and $Q_2$ are mixed and are subsequently conveyed through a divergent section 20 which is adjacent to the inlet of the impeller 7.

Downstream of the outlet section 14 of the impeller 7 there is a diffuser 21 which is fixed to the case 2 and has blades 22 of a per se known shape. Re-conveyance chambers 23 are furthermore provided and direct the flow leaving the diffuser toward the internal chamber 15 of the case.

According to a peculiar characteristic of the invention, downstream of the impeller 7 and the diffuser 21 there is a radial-centripetal conveyor, generally indicated by reference numeral 24, which has an annular outlet section which extends peripherally to the diffusion duct of the ejector 17.

In particular, the radial-centripetal conveyor 24 is formed by a pair of walls 25, 26 which are approximately parallel to the crown 11 of the impeller 7 and define between one another a substantially annular or torus-like interspace which is suitable for conveying the fluid which leaves the impeller partially toward the center of the case 2.

Inside said interspace there is a plurality of straightening blades 27 having appropriate profiles which determine a plurality of conveyance channels 28 with an approximately constant transverse cross section.

The conveyance channels 28 have an end portion which is substantially parallel to the diffusion duct 19 of the ejector, with a transverse annular outlet section 29 which is substantially perpendicular to the rotational axis of the impeller.

The inner walls of the conveyance channels, particularly at the inlet and outlet portions, are accurately contiguous so that the outflowing liquid is as regularized as possible and approximately laminar, creating a roughly tubular fluid nappe which aids the separation of the air contained in the fluid mixture accelerated by the impeller and facilitates the migration of air toward the delivery port.

The laminar outflow conditions furthermore facilitate the recirculation of the flow $Q_2$ toward the ejection nozzle 17, increasing the efficiency of the ejector and consequently the flow $Q_2$ of the drawn liquid. This leads to a significant reduction in priming times, which by means of tests have been found to be between 3.5 and 4.5 minutes. The efficiency of the pump during normal running conditions is furthermore also considerably increased up to 0.30–0.35.

Figure 3:
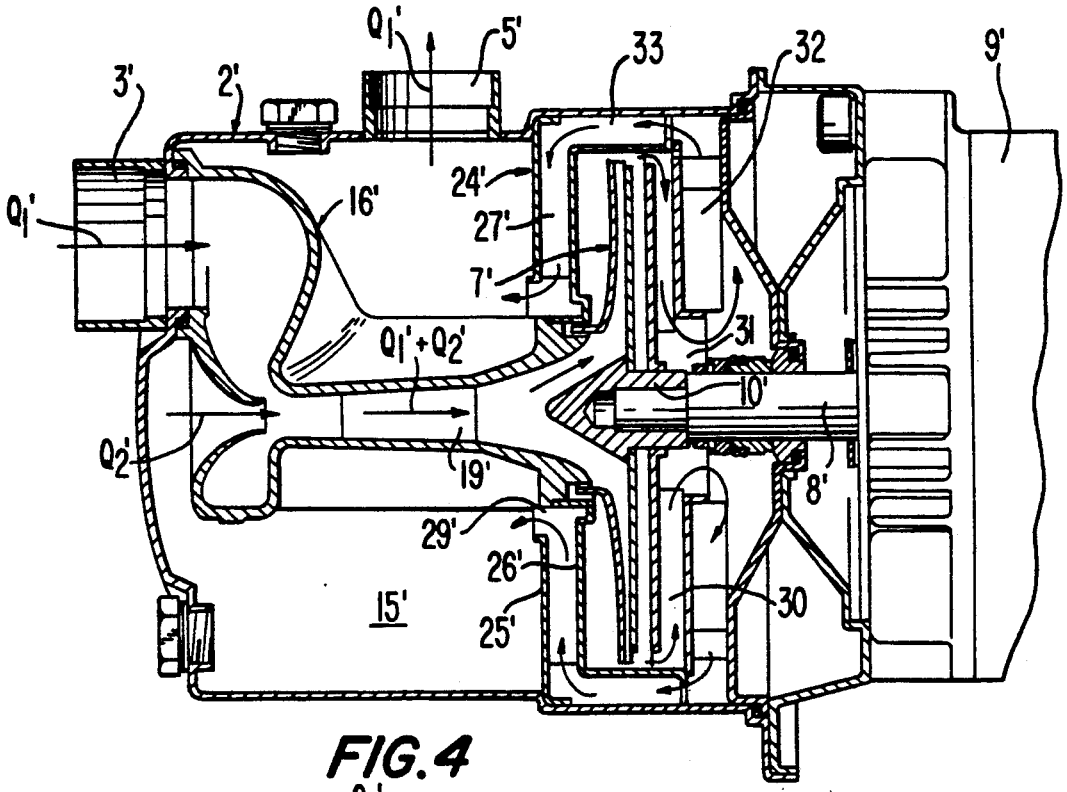
FIG. 3 is a partial sectional side view of a second embodiment of the pump according to the invention.
Figure 4:
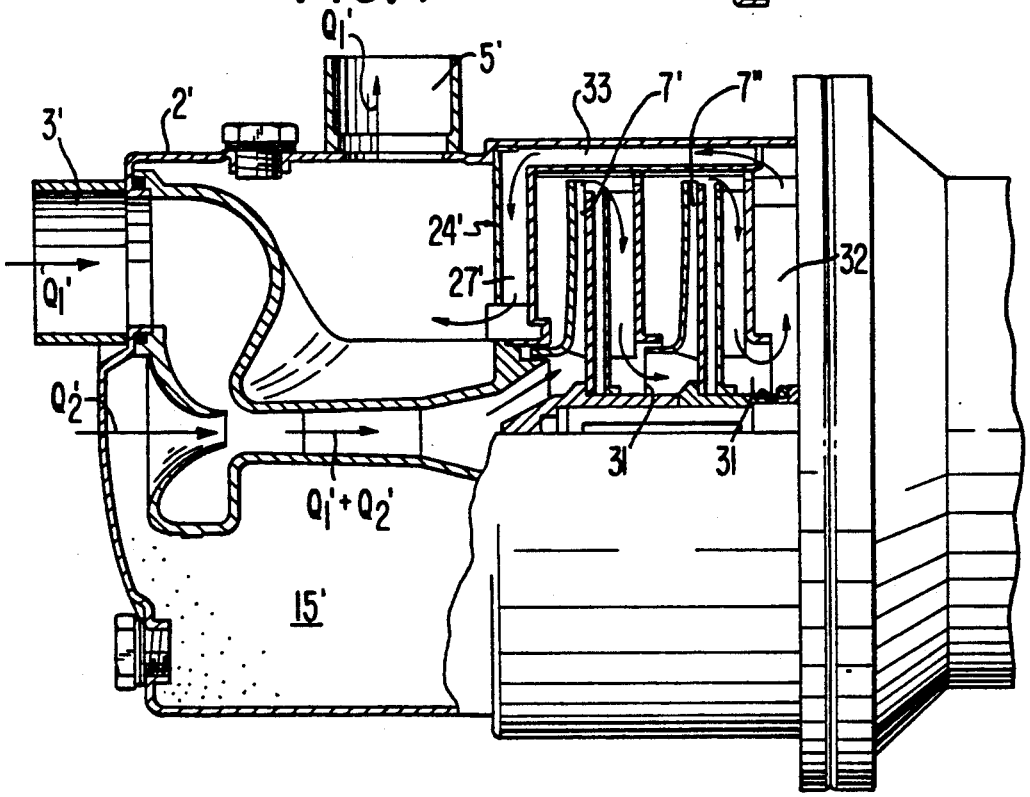
FIG. 4 is a partial sectional side view of an embodiment of the pump according to the invention which is similar to that of FIG. 3 in the case of a double impeller.

FIGS. 3 and 4 illustrate a second embodiment of the pump according to the invention, wherein, differently from the first embodiment, the annular diffuser is not provided at the output of the impeller. In particular, FIG. 3 illustrates a single-stage pump and FIG. 4 illustrates a two-stage pump with double impeller. By analogy, the component elements which are identical to those of the first embodiment have been identified by the same reference numerals followed by a prime.

The centripetal radial conveyor 24' of FIG. 3 is formed by the walls 25', 26' and by the straightening blades 27' which define the conveyance channels.

The outlet section 29' of the conveyor has an annular shape and is arranged peripherally to the outer portion of the diffusion duct 19' of the ejector 16'.

At the output end of the impeller 7', or of the impeller 7'', the flow is deflected toward the conveyor 24' through a plurality of re-conveyance channels which comprise a series of radial-centripetal channels 30, a first axial annular duct 31 adjacent to the hub 10' of the impeller 7', an annular radial-centripetal duct 32 which extends parallel to the series of channels 30, and a second peripheral axial annular duct 33 which is connected to the conveyance channels.

By means of this succession of re-conveyance channels, the flow is guided through the channels of the conveyor 24' and is directed into the inner chamber 15' of the case 2'.

In this case, too, the total flow Q produced by the impeller 3' is conveyed toward the central portion of the case adjacent to the outer wall of the diffusion duct 19', in a position which is sufficiently distant from the delivery port 5' to facilitate the separation and migration of air toward the delivery port 5'.

From the constructive point of view, the conveyors 24, 24' can be provided by means of the same materials used for the stator case of the pump or of the ejector and can be applied to, or provided monolithically with, one of the fixed components of the pump casing. The shape and number of the straightening blades 27, 27' can be determined by means of conventional calculation processes for re-conveyance ducts arranged downstream diffusers, typical of multi-stage centrifugal pumps. In particular, the angles of radial divergence must be concordant with those of the impeller at the inflow and nil at the outflow; the number of blades or chambers may be conveniently between 3 and 10 is preferably equal to 5.

In practice it has been observed that the self-priming centrifugal pump according to the invention fully achieves the intended aim since it allows a drastic reduction of priming times and the obtainment of high operating efficiencies during normal running conditions.

The self-priming centrifugal pump according to the invention is susceptible to numerous modifications and variations, all of which are within the scope of the inventive concept defined in the accompanying claims; all the details may furthermore be replaced with technically equivalent elements. In practice, the materials employed, so long as compatible with the specified use, as well as the dimensions and shapes, may be any according to the requirements and the state of the art.

I claim:

1. A self-priming centrifugal pump comprising:

a case including a substantially cylindrical lateral wall and a front wall extending across one end of the lateral wall so as to define an internal chamber therein;

at least one radial-centrifugal type of impeller rotatably supported within said internal chamber about an axis of rotation thereof for inducing fluid to flow through the pump, said impeller having a hub, a crown connected to said hub at an inlet side of the impeller, and blades extending radially from said hub;

an inlet port and an outlet port extending through said front wall and said lateral wall, respectively, at one side of the axis of rotation of said impeller;

an ejector disposed inside said case for introducing fluid to the inlet side of said impeller, said ejector defining a suction chamber therein communicating with said inlet port, and said ejector having a nozzle communicating with said internal chamber, and a diffusion duct extending coaxial to said impeller, said diffusion duct communicating with said suction chamber, with said nozzle, and with said impeller at the inlet side thereof; and conveyor means for directing the entire flow of liquid induced by said impeller toward a central portion of said internal chamber under substantially laminar flow conditions so as to facilitate a separation of air entrained within the liquid and a migration thereof towards said outlet port, said conveyor means comprising at least one pair of walls spaced from one another and extending approximately parallel to the crown of said impeller at the inlet side thereof so as to define a substantially annular or torus-like interspace between the walls downstream of said impeller with respect to the direction of flow of liquid in the pump, a plurality of straightening blades disposed in said interspace and extending radially with respect to said interspace so as to divide said interspace into conveyance channels, and an outlet section disposed at a downstream end of the conveyor means and defining an annular space therein extending around the diffusion duct of said ejector, the outlet section extending in an axial direction at least partially parallel to said diffusion duct so as to direct the fluid adjacent to the outer periphery of said diffusion duct; and a diffuser interposed between said impeller and said conveyor means and extending peripherally outwardly of said impeller adjacent to the lateral wall of said case, said diffuser being of a radial type having blades defining outlet sections which coincide with the inlet ends of said conveyance channels and having an angle of radial divergence which is opposite to that of the blades of said impeller.

2. A self-priming centrifugal pump, according to claim 1, wherein the outlet section of said conveyor means extends at least partially parallel to said diffusion duct and the annular space defined therein lies in a plane approximately perpendicular to the axis of rotation of said impeller.

3. A self-priming centrifugal pump, according to claim 1, wherein said straightening blades have a radial angle of divergence which is concordant with the angle of the blades of said impeller, the number of said straightening blades being between 3 and 10.

4. A self-priming centrifugal pump, according to claim 3, wherein the number of said straightening blades is 5.

5. A self-priming centrifugal pump, according to claim 1, wherein inner surfaces of the walls of said conveyor means are accurately contiguous so as to minimize losses due to friction and boundary layer separations.

6. A self-priming centrifugal pump, according to claim 1, and further comprising a diffuser interposed between said impeller and said conveyor means, said diffuser having blades defining outlet sections which coincide with inlet ends of said conveyance channels and having an angle of radial divergence which is opposite to that of the blades of said impeller.

7. A self-priming centrifugal pump, according to claim 1, and further comprising a plurality of mutually connected ducts interposed between said at least one impeller and said conveyor means, said plurality of ducts including, in succession, a series of radial-centripetal ducts which extend adjacent to the hub of said at least one impeller, a first axial annular duct which extends peripherally to said hub, a radial-centrifugal duct which extends substantially parallel to said series of radial-centripetal ducts, and a second axial annular duct arranged peripherally to said at least one impeller and connected to said conveyor means.

8. A self-priming centrifugal pump, according to claim 1, wherein the transverse cross section of said conveyance channels is substantially constant along the length thereof.

9. A self-priming centrifugal pump, according to claim 1, wherein the transverse cross section of said conveyance channels decreases with continuity from inlet to outlet ends thereof.

10. A self-priming centrifugal pump, according to claim 1, and further comprising a radial diffuser having blades interposed between said impeller and said conveyance channels.

11. A self-priming centrifugal pump comprising:

a case including a substantially cylindrical lateral wall and a front wall extending across one end of the lateral wall so as to define an internal chamber therein;

at least one radial-centrifugal type of impeller rotatably supported within said internal chamber about an axis of rotation thereof for inducing fluid to flow through the pump, said impeller having a hub, a crown connected to said hub at an inlet side of the impeller, and blades extending radially from said hub;

an inlet port and an outlet port extending through said front wall and said lateral wall, respectively, at one side of the axis of rotation of said impeller;

an ejector disposed inside said case for introducing fluid to the inlet side of said impeller, said ejector defining a suction chamber therein communicating with said inlet port, and said ejector having a nozzle communicating with said internal chamber, and a diffusion duct extending coaxial to said impeller, said diffusion duct communicating with said suction chamber, with said nozzle, and with said impeller at the inlet side thereof; and conveyor means for directing the entire flow of liquid induced by said impeller toward a central portion of said internal chamber, adjacent to the outer periphery of said diffusion duct, under substantially laminar flow conditions so as to facilitate a separation of air entrained within the liquid and a migration thereof towards said outlet port, said conveyor means comprising at least one pair of walls mutually spaced apart from one another and extending approximately parallel to the crown of said impeller at the inlet side thereof so as to define a substantially annular or torus-like interspace between the walls downstream of said impeller with respect to the direction of flow of liquid in the pump, a plurality of straightening blades disposed in said interspace and extending radially with respect to said interspace so as to divide said interspace into conveyance channels, and an outlet section disposed at a downstream end of the conveyor means and defining an annular space therein extending around the diffusion duct of said ejector; and a plurality of mutually connected ducts interposed between said at least one impeller and said conveyor means, said plurality of ducts including, in succession, a series of radial-centripetal ducts which extend adjacent to the hub of said at least one impeller, a first axial annular duct which extends peripherally to said hub, a radial-centrifugal duct which extends substantially parallel to said series of radial-centripetal ducts, and a second axial annular duct arranged peripherally to said at least one impeller and connected to said conveyor means.

* * * * *